US008727741B2

(12) United States Patent
Nutz et al.

(10) Patent No.: US 8,727,741 B2
(45) Date of Patent: May 20, 2014

(54) PORTABLE AIR COMPRESSOR

(75) Inventors: Hans E. Nutz, Easley, SC (US); Nicholas Kerr, Raleigh, NC (US); Andrew W. Pillman, Greenwood, SC (US); Richard L. Strack, Anderson, SC (US)

(73) Assignee: Techrtronic Power Tools Technology Limited, Tortola (VG)

( * ) Notice: Subject to any disclaimer, the term of this patent is extended or adjusted under 35 U.S.C. 154(b) by 584 days.

(21) Appl. No.: 12/940,619

(22) Filed: Nov. 5, 2010

(65) Prior Publication Data

US 2011/0158828 A1 Jun. 30, 2011

Related U.S. Application Data

(60) Provisional application No. 61/258,477, filed on Nov. 5, 2009.

(51) Int. Cl.
*F04B 53/00* (2006.01)
*E03B 5/00* (2006.01)

(52) U.S. Cl.
USPC ..... 417/234; 137/565.18

(58) Field of Classification Search
USPC ..... 417/234, 410.1; 137/565.18
See application file for complete search history.

(56) References Cited

U.S. PATENT DOCUMENTS

| | | | |
|---|---|---|---|
| 915,950 | A | 3/1909 | Gibson |
| 1,415,047 | A | 5/1922 | Parsons |
| 1,639,959 | A | 8/1927 | Owen |
| 1,756,806 | A | 4/1930 | Beach |
| 2,122,656 | A | 7/1938 | Paget |
| 2,434,675 | A | 1/1948 | Simpson |
| 3,450,121 | A | 6/1969 | Roosa |
| 3,977,815 | A | 8/1976 | Stuff |
| 4,902,226 | A | 2/1990 | Elliott et al. |
| 5,087,824 | A | 2/1992 | Nelson |
| 5,378,119 | A | 1/1995 | Goertzen |
| 6,364,628 | B1 | 4/2002 | Potts et al. |
| 6,406,270 | B1 | 6/2002 | Kopel |

(Continued)

FOREIGN PATENT DOCUMENTS

WO 2010042597 4/2010

OTHER PUBLICATIONS

Rolair Systems, "Models D2002HPV5/D2002HSSV5", Apr. 2008.*

(Continued)

*Primary Examiner* — Charles Freay
(74) *Attorney, Agent, or Firm* — Michael Best & Friedrich LLP

(57) ABSTRACT

A portable air compressor includes an air tank for storing compressed air, the air tank having a generally flattened spherical shape defining a circumference lying in a plane oriented substantially perpendicular to a support surface in a resting position. The portable air compressor also includes compressor components in fluid communication with the air tank for providing compressed air to the air tank, the compressor components positioned adjacent to the air tank substantially on one side of the plane. At least one foot is coupled to the air tank and extends substantially parallel to the plane, the at least one foot for at least partially supporting the air compressor on the support surface such that the plane is oriented substantially perpendicular to the support surface. A handle extends from the air tank substantially parallel to the plane and in a direction generally opposite the at least one foot.

27 Claims, 8 Drawing Sheets

(56) References Cited

U.S. PATENT DOCUMENTS

| | | | | |
|---|---|---|---|---|
| D471,919 | S | 3/2003 | Buck | |
| 6,532,990 | B1 | 3/2003 | Wood et al. | |
| 6,532,991 | B1 * | 3/2003 | Wood et al. | 137/899.4 |
| 6,537,039 | B2 * | 3/2003 | Mann | 417/234 |
| D500,328 | S | 12/2004 | Lucchi | |
| 6,991,437 | B2 | 1/2006 | Cherry et al. | |
| 6,994,529 | B2 * | 2/2006 | Downes | 417/234 |
| 7,413,414 | B2 | 8/2008 | Wood et al. | |
| 7,832,991 | B2 * | 11/2010 | Wood et al. | 417/234 |
| 2002/0131872 | A1 * | 9/2002 | Lucchi | 417/234 |
| 2002/0153196 | A1 * | 10/2002 | Dooley | 181/228 |
| 2004/0094921 | A1 | 5/2004 | Groskreutz | |
| 2004/0175276 | A1 * | 9/2004 | Downes | 417/234 |
| 2004/0197200 | A1 * | 10/2004 | Wood et al. | 417/234 |
| 2005/0163625 | A1 * | 7/2005 | Cherry et al. | 417/234 |
| 2005/0191187 | A1 * | 9/2005 | Vos et al. | 417/234 |
| 2005/0196290 | A1 * | 9/2005 | Hu | 417/234 |
| 2006/0067836 | A1 | 3/2006 | Smith et al. | |
| 2006/0104830 | A1 | 5/2006 | Fields | |
| 2006/0140784 | A1 * | 6/2006 | Baron et al. | 417/234 |
| 2006/0144468 | A1 | 7/2006 | Lewis et al. | |
| 2006/0245937 | A1 | 11/2006 | Goodwin et al. | |
| 2008/0044296 | A1 * | 2/2008 | Wood et al. | 417/234 |
| 2008/0187447 | A1 * | 8/2008 | Steinfels et al. | 417/234 |
| 2008/0273994 | A1 * | 11/2008 | Sadkowski et al. | 417/234 |
| 2009/0053076 | A1 * | 2/2009 | Vos et al. | 417/234 |
| 2009/0194177 | A1 * | 8/2009 | Yokota et al. | 137/565.18 |
| 2010/0111717 | A1 * | 5/2010 | Schultz et al. | 417/234 |
| 2010/0193054 | A1 * | 8/2010 | Hernandez et al. | 137/565.18 |
| 2011/0123362 | A1 * | 5/2011 | Etter et al. | 417/234 |
| 2011/0182754 | A1 * | 7/2011 | Gathers et al. | 417/234 |
| 2011/0284109 | A1 * | 11/2011 | Ishibashi et al. | 137/565.18 |
| 2012/0321488 | A1 * | 12/2012 | Ritterling et al. | 417/234 |

OTHER PUBLICATIONS

Fiac Air Compressors, Petrol Engine Air Compressors dated May 2006 (12 pages).

Fiac Air Compressors, Belt Driven Air Compressors dated Mar. 2004 (8 pages).

PCT/US2009/059812 International Search Report dated Nov. 16, 2009 (1 page).

Porter Cable, Pancake Air Compressor dated Nov. 2, 2009 (2 pages).

Rolair Systems, Air Compressor available prior to Nov. 5, 2010 (1 page).

* cited by examiner

PORTABLE AIR COMPRESSOR

CROSS-REFERENCE TO RELATED APPLICATION

This application claims priority to co-pending U.S. Provisional Patent Application No. 61/258,477 filed on Nov. 5, 2009, the entire contents of which are incorporated herein by reference.

BACKGROUND

The present invention relates to air compressors and, more particularly, to portable air compressors.

Conventional portable air compressors are cumbersome and awkward for a user. More specifically, the handle is in a position that prevents the user from efficiently transporting the air compressor around a worksite. For example, the handle may be positioned such that the user has to bend to reach the handle and/or hold the unit away from the user's body to accommodate the size of the unit.

In current portable air compressors, all of the support feet are usually located on the air tank, such that the diameter of the air tank is horizontal with respect to a support surface. In this orientation, the motor/compressor is positioned on top of the air tank, such that the air tank is positioned between the ground surface and the motor/compressor. Accordingly, the handle is located solely on the motor/compressor, which makes access to the handle inconvenient for the user and positions the air compressor awkwardly at the side of the user's body.

SUMMARY

In one aspect, the invention provides a portable air compressor having a resting position in which the air compressor is supported on a support surface. The portable air compressor includes an air tank for storing compressed air, the air tank having a generally flattened spherical shape defining a circumference having a diameter and lying in a plane, the generally flattened spherical shape also defining a width perpendicular to the plane. The diameter is greater than the width, and the plane is oriented substantially perpendicular to the support surface when the air compressor is in the resting position. The portable air compressor also includes compressor components in fluid communication with the air tank for providing compressed air to the air tank. The compressor components are positioned adjacent to the air tank substantially on one side of the plane of the air tank. At least one foot is coupled to the air tank and extends from the air tank in a direction substantially parallel to the plane of the air tank, the at least one foot for at least partially supporting the air compressor on the support surface such that the plane is oriented substantially perpendicular to the support surface when the tank is in the resting position. A handle extends from the air tank in a direction substantially parallel to the plane of the air tank and in a direction generally opposite the at least one foot.

In another aspect, the invention provides a portable air compressor having a resting position in which the air compressor is supported on a support surface. The portable air compressor includes an air tank for storing compressed air, the air tank having a generally flattened spherical shape defining a circumference having a diameter and lying in a plane, the generally flattened spherical shape also defining a width perpendicular to the plane, wherein the diameter is greater than the width, and wherein the plane is oriented substantially perpendicular to the support surface in the resting position.

The portable air compressor also includes compressor components in fluid communication with the air tank for providing compressed air to the air tank, the compressor components positioned adjacent to the air tank substantially on one side of the plane of the air tank in the resting position. A handle extends from the air tank in a direction substantially parallel to the plane of the air tank, the handle including a grip portion for a user to grasp when transporting the air compressor. The direction in which the handle extends generally defines an axis passing through the grip portion that passes near a center of gravity of the air compressor.

In another aspect, the invention provides a portable air compressor having a resting position in which the air compressor is supported on a support surface. The portable air compressor includes an air tank for storing compressed air, compressor components in fluid communication with the air tank for providing compressed air to the air tank, and a housing substantially enclosing the compressor components. The housing includes a first air inlet, a second air inlet, an air outlet, a first tortuous flow path between the first air inlet and the air outlet, and a second tortuous flow path between the second air inlet and the air outlet. The first tortuous flow path and the second tortuous flow path converge to form a third flow path upstream of the air outlet and downstream of the compressor components.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

DETAILED DESCRIPTION

Portable air compressors are useful on worksites for portability by a single user. Accordingly, the ease by which a user can transport and move the portable air compressor about a worksite is an important design consideration. Factors that contribute to portability include, among other things, a carrying handle positioned at a height to minimize bending by the user, an air tank shape conducive to carrying the compressor unit close to a user's body, and compact size of the compressor unit. Noise attenuation is another important design consideration. Sound baffling/muffling to reduce the decibel level of the running compressor is also advantageous.

FIGS. 1-9 illustrate an air compressor 10 according to one embodiment of the invention. The illustrated air compressor 10 is a portable air compressor that is transportable between worksites (e.g., construction sites, garages, etc.). The air compressor 10 provides a source of compressed air for performing various tasks such as operating pneumatic power tools, filling vehicle tires, or the like. In the illustrated embodiment, the air compressor 10 is designed as a relatively compact unit that is movable around a worksite by a single user.

Figure 1:
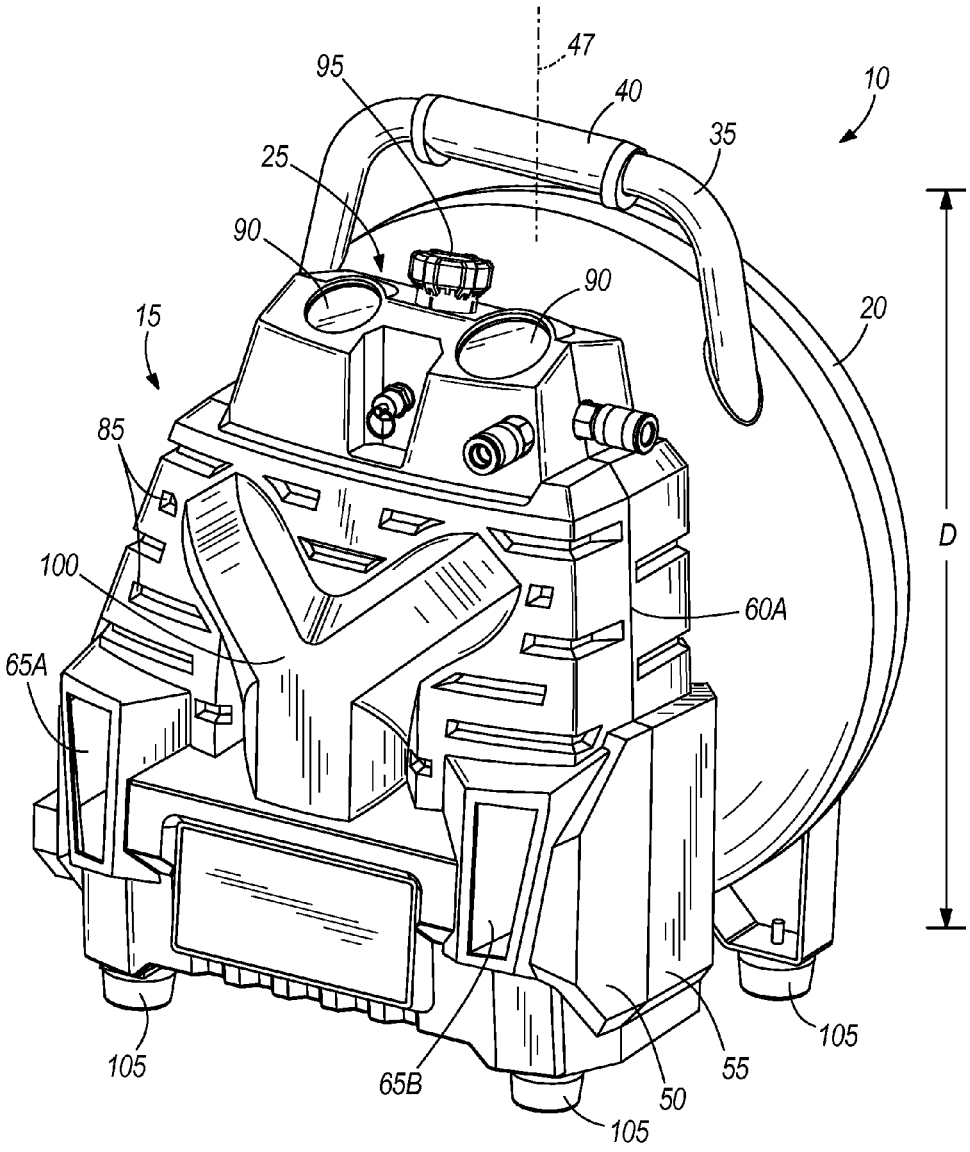
FIG. 1 is a front perspective view of a portable air compressor according to one embodiment of the invention.
Figure 2:
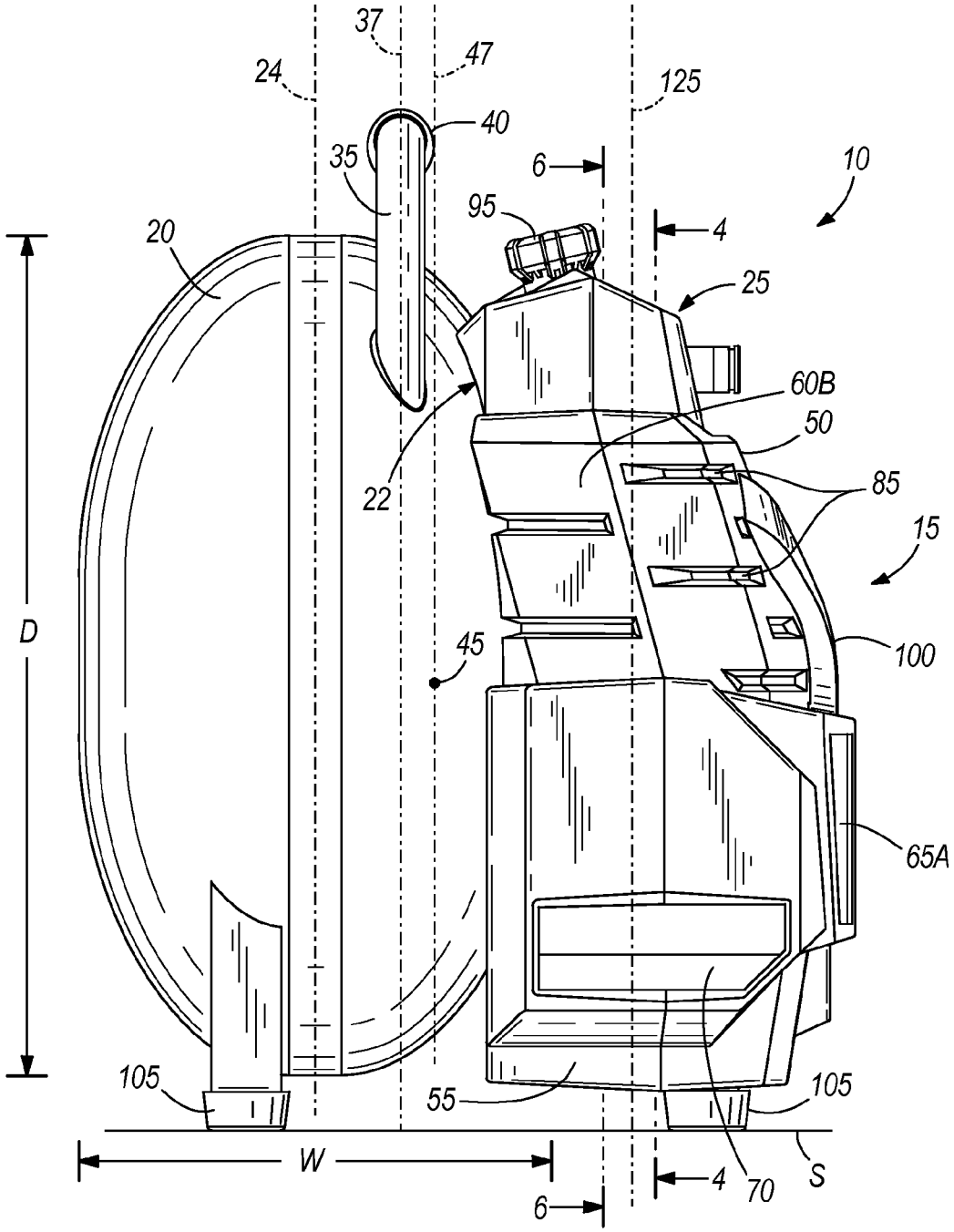
FIG. 2 is side view of the portable air compressor shown in FIG. 1.
Figure 3:
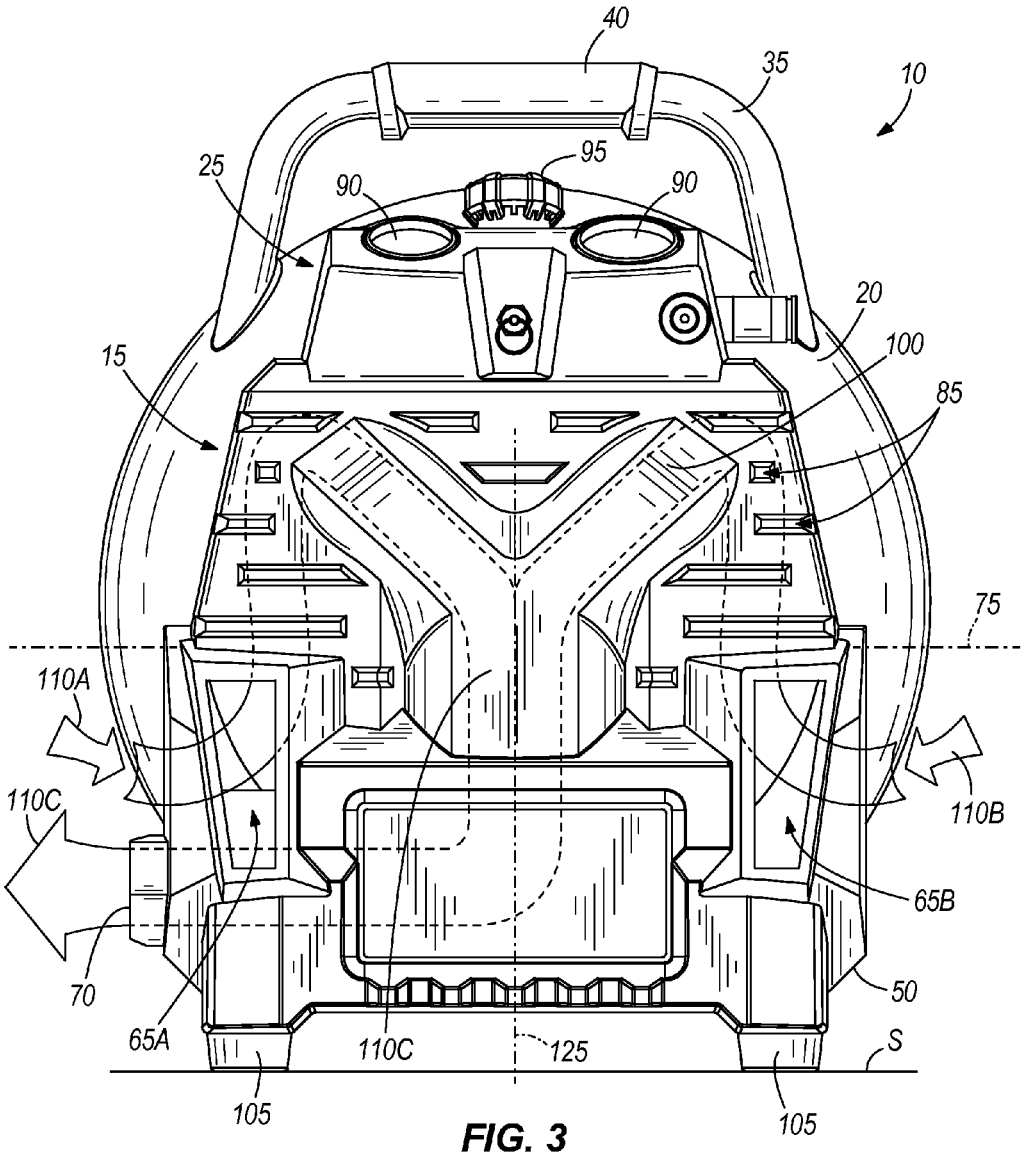
FIG. 3 is a front view of the portable air compressor shown in FIG. 1 illustrating a plurality of air flow paths.
Figure 4:
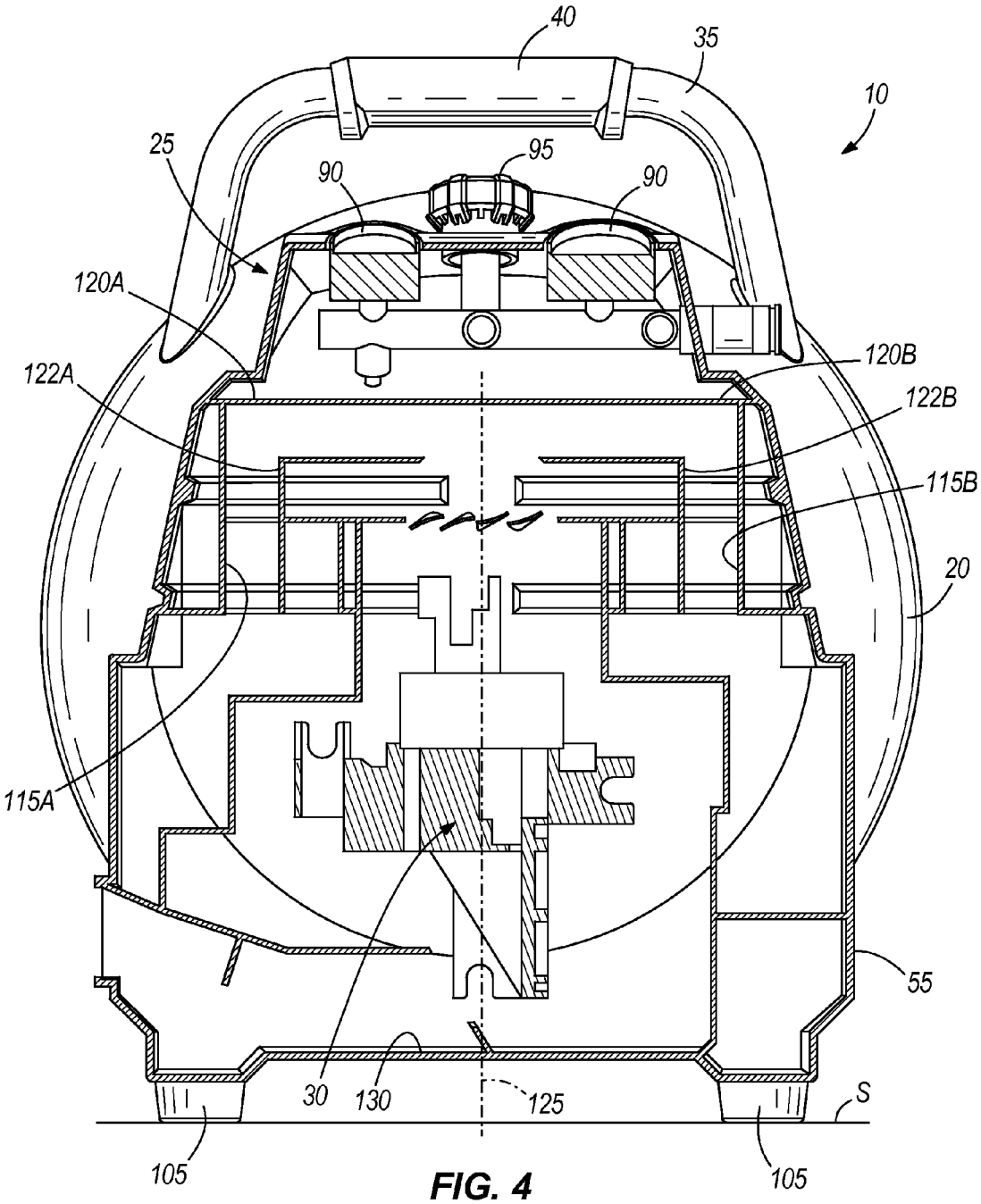
FIG. 4 is a cross section of the portable air compressor taken along line 4-4 of FIG. 2 illustrating a plurality of air flow paths and a portion of a motor/compressor assembly.
Figure 5:
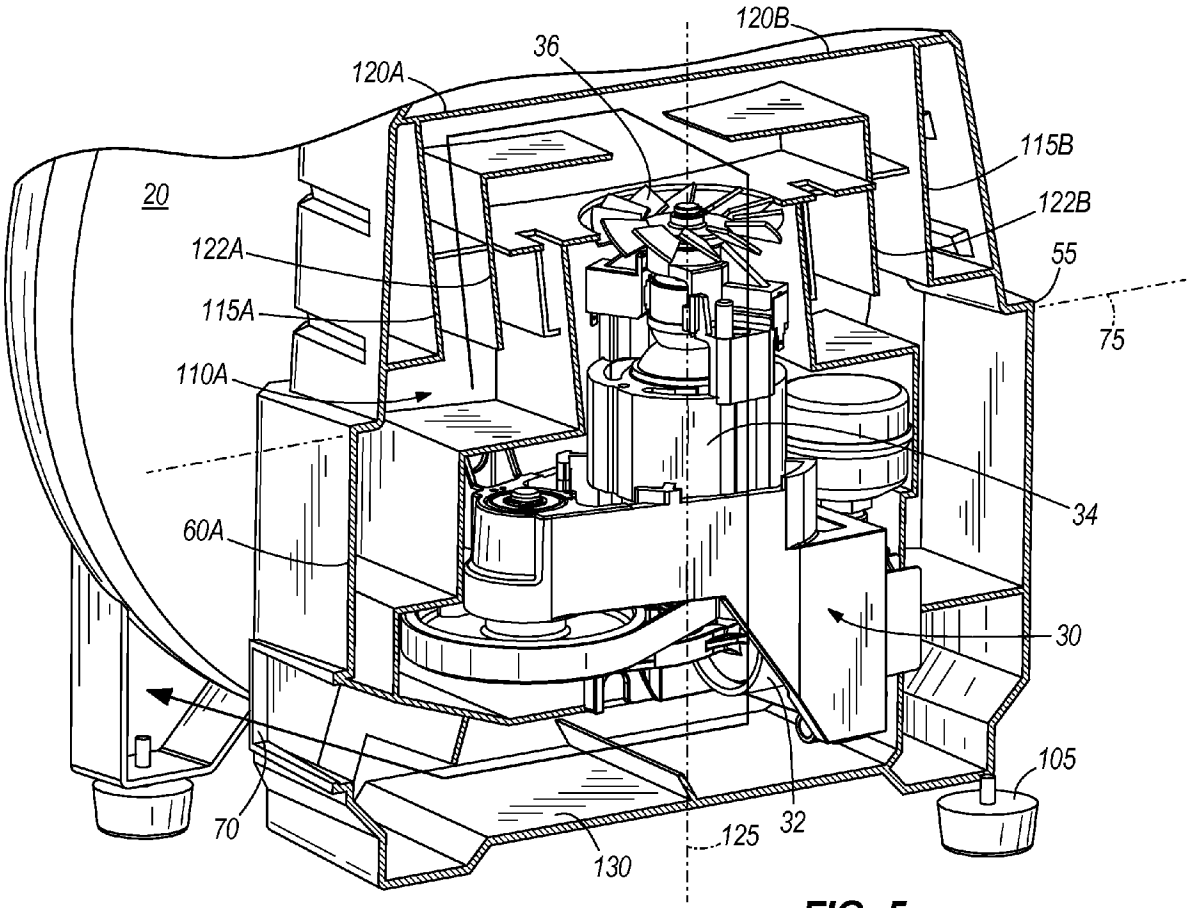
FIG. 5 is a perspective view of a portion of the cross section of FIG. 4 illustrating the plurality of air flow paths and the motor/compressor assembly.
Figure 6:
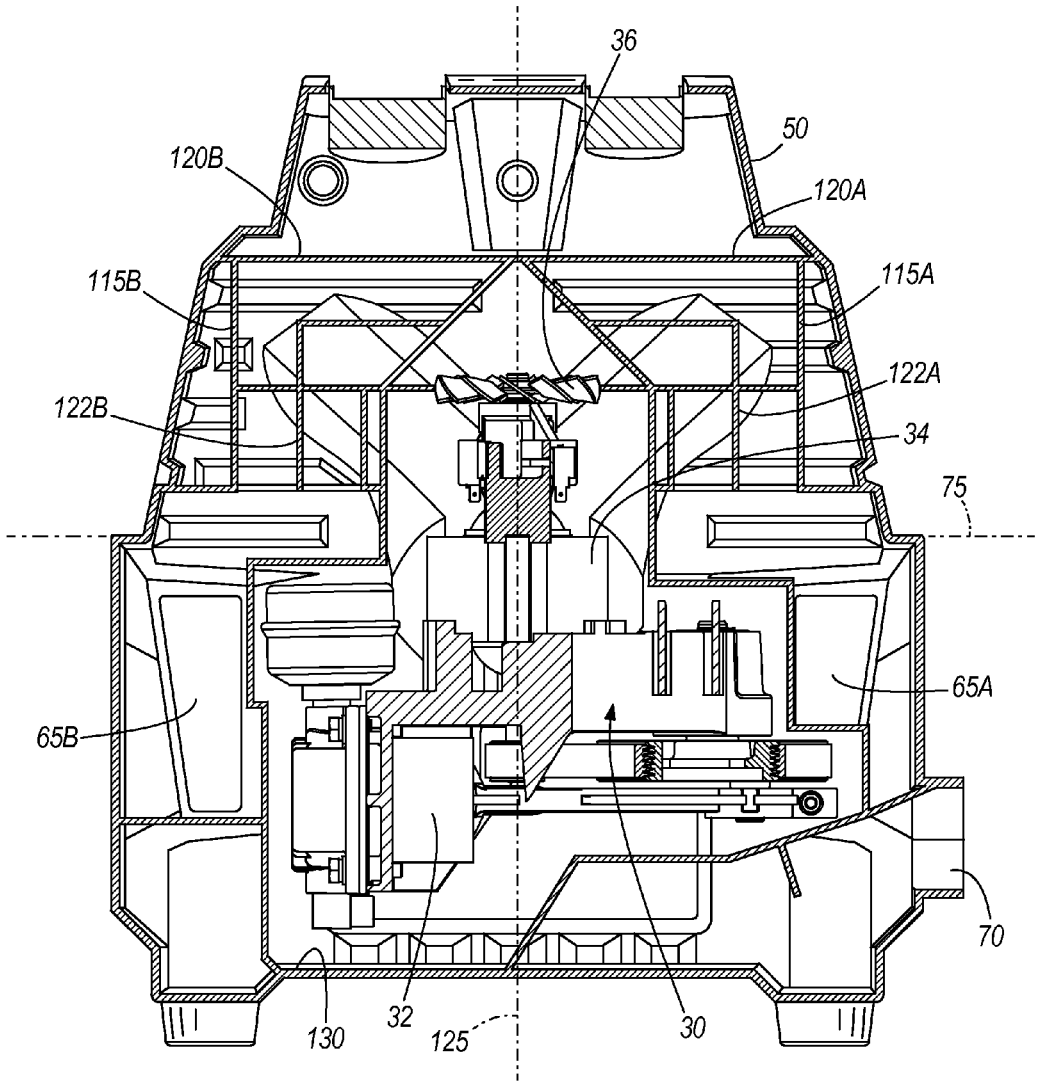
FIG. 6 is a cross-section of the portable air compressor taken along line 6-6 of FIG. 2 illustrating a plurality of air flow paths and a portion of the motor/compressor assembly.

Referring to FIGS. 1-9, the portable air compressor 10 includes a housing 15, an air tank 20, a control assembly 25, and a motor/compressor assembly 30 (FIGS. 4-6). The air tank 20 is positioned adjacent the housing 15. The illustrated air tank 20 has a generally flattened or torso spherical shape (i.e., a "pancake" style air tank) defining a circular circumference in a plane 24. The plane 24 of the circumference is oriented perpendicular to a support surface S, which may be the ground. The circumference has a diameter D and also defines a width W in a direction perpendicular to the plane 24 and parallel to the support surface S (FIG. 2). The outer diameter D is generally greater than the width W due to the flattened shape of the air tank 20. The plane 24 defines a first side and a second side opposite the first side, the motor/compressor assembly 30, the control assembly 25 and the housing 15 being positioned entirely on the first side of the plane 24. The air tank 20 also includes an axis in a direction perpendicular to the support surface S and parallel to the plane 24, which in the illustrated embodiment extends from a bottom surface of the tank to a handle of the tank.

Figure 7:
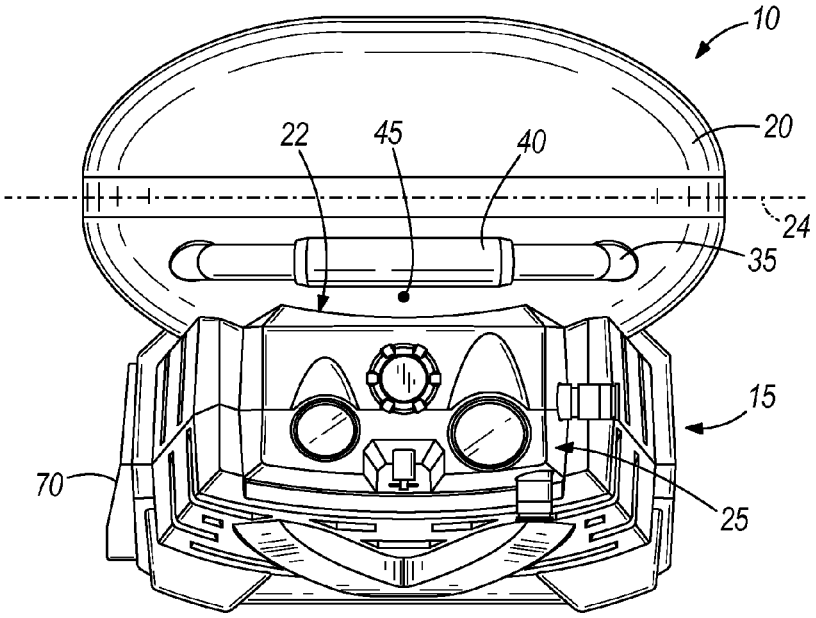
FIG. 7 is a top view of the portable air compressor shown in FIG. 1.

The housing 15 defines a center axis 125 extending longitudinally through the housing 15. The air tank 20 is positioned adjacent the housing 15 such that the tank axis and the center axis 125 extend parallel to each other, are non-coincident, and are both perpendicular to the support surface S. Likewise, the center axis 125 of the housing 15 extends parallel to the plane 24 of the circular circumference of the air tank 20. As best illustrated in FIGS. 2 and 7, a portion of the air tank 20 is received by a concave outer surface 22 of the housing 15 for communication with the motor/compressor assembly 30 to receive pressurized air. As best illustrated in FIG. 2, the housing 15 receives the portion of the air tank 20 in a location positioned between the plane 24 of the air tank 20 and the center axis 125 of the housing 15 such that the air tank 20 and the housing 15 are positioned side-by-side. The air tank 20 is configured to withstand and store a high volume, such as six gallons (about 23 liters), of compressed air produced during air compressor operation.

As illustrated, the air tank 20 is oriented such that the plane 24 of the tank circumference is perpendicular with respect to the support surface S. As described above, the axis of the air tank 20 is measured in a direction generally perpendicular to the support surface S, while the width W of the air tank 20 is measured in a direction generally parallel to the support surface S and perpendicular to the plane 24. Orienting the air tank 20 to be supported on the support surface S such that the largest dimension is positioned perpendicular to the support surface reduces the overall width of the portable air compressor 10, placing a center of gravity 45 of the portable air compressor 10 closer to a user's body, thus making the air compressor easier to transport and easier to store. The air tank 20 also includes a substantially smooth surface, which also contributes to ease of portability for a user. The dimensions, the ratio, the volume and the maximum operating pressure of the air tank 20 are based on the different size and power specifications of the portable air compressor 10.

The air tank 20 also includes a handle 35 positioned on a side of the air tank 20 opposite the support surface S and extending away from the air tank 20 in a direction parallel to the plane 24 of the air tank 20 as defined above. In the illustrated embodiment, the handle 35 is integrally formed with the air tank 20. In other embodiments, the handle may be a separate component that is secured to the air tank with bolts, screws, adhesives, or the like. The handle 35 provides a sturdy location on the air tank 20 for a user or lifting device to grasp and support the air compressor 10. Orienting the air tank 20 to be supported on the support surface S such that the largest dimension is positioned perpendicular to the support surface S and positioning the handle 35 opposite the support surface S provide that the user has to minimally bend to reach the handle 35. The handle 35 includes a grip portion that is shaped and contoured as a comfortable location for a user to grip the air compressor 10 when loading and unloading the air compressor 10 from, for example, a vehicle. As illustrated, the handle 35 also includes a rubber grip 40 positioned on the grip portion of the handle 35. However, in other embodiments, the grip 40 may be formed of another suitable material or combination of suitable materials. In still other embodiments, the handle may not have a grip positioned on the grip portion.

Figure 8:
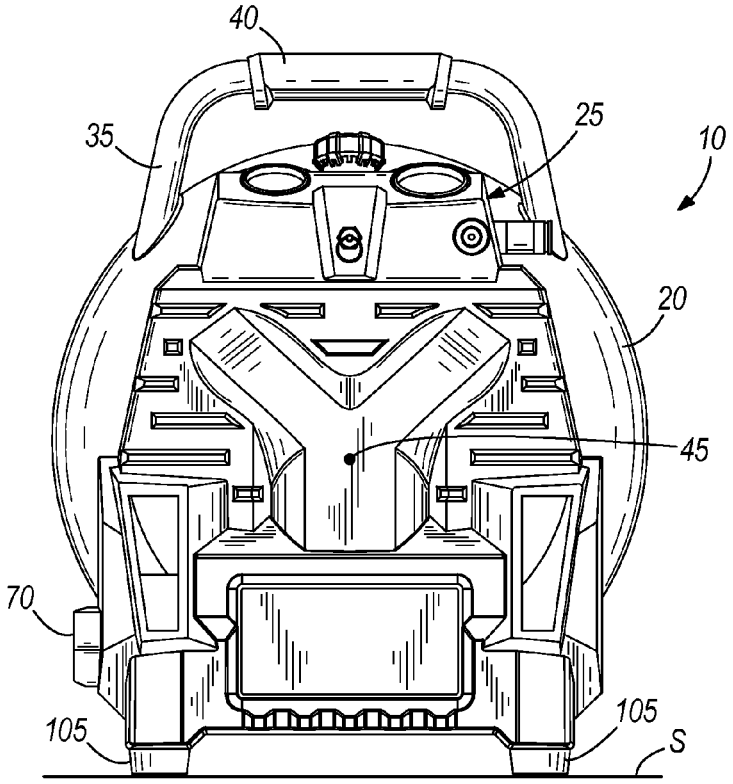
FIG. 8 is a front view of the portable air compressor shown in FIG. 1.
Figure 9:
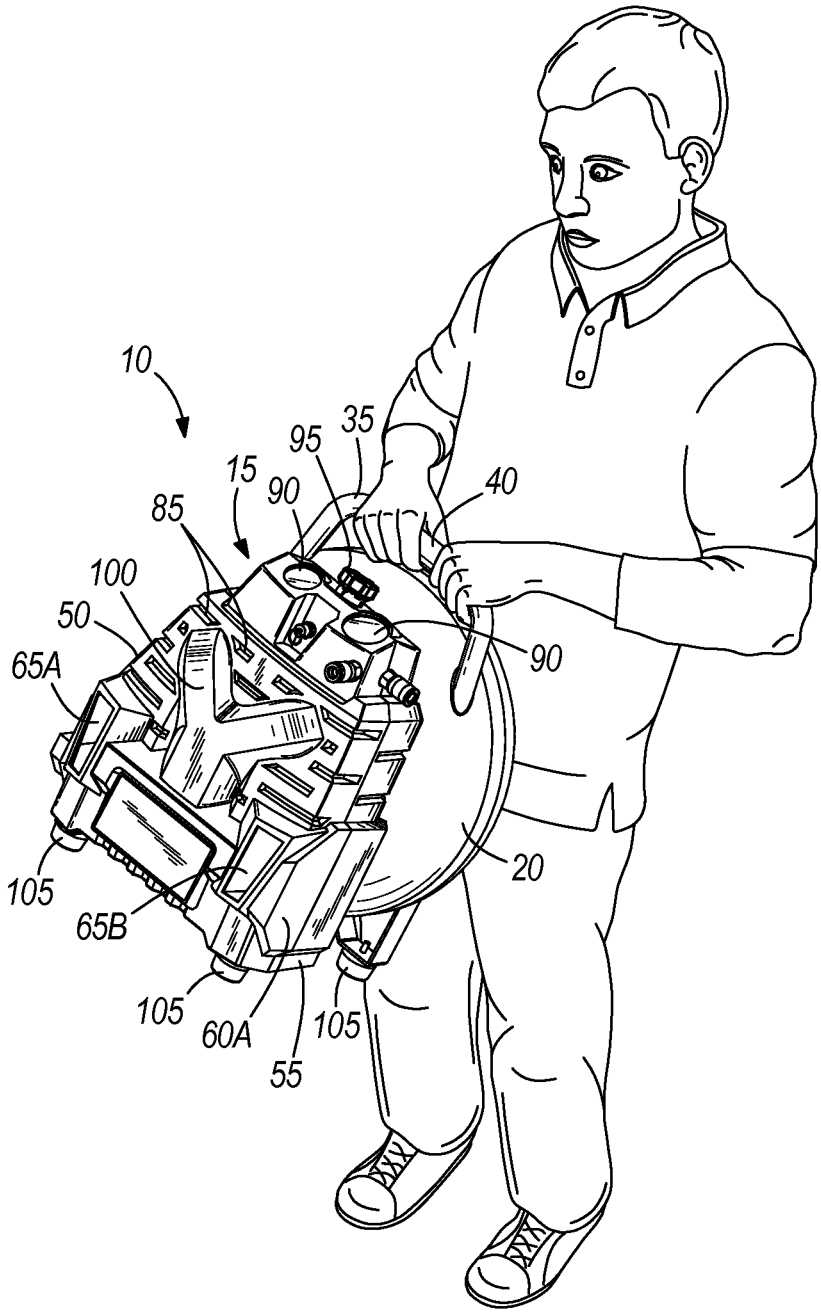
FIG. 9 is a perspective view of the portable air compressor shown in FIG. 1 in operation by a user.

The center-of-gravity 45 of the portable air compressor unit 10 is horizontally located approximately mid-way between the outermost portion of the air tank 20 and the outermost portion of the housing 15 when the air compressor 10 is viewed from the side as shown in FIG. 2. In another view of the air compressor 10, as shown in FIG. 8, the center-of-gravity 45 is located approximately mid-way between the support surface S and the top of the air tank 20. In another view of the air compressor, as shown in FIG. 7, the center of gravity 45 lies on the first side of the plane 24 and defines an axis 47 (FIGS. 1-2) extending perpendicular to the support surface and parallel to the plane 24. The axis 47 passes through the air tank 20. Thus, the center-of-gravity 45 lies within the air compressor 10.

The handle 35 is slightly offset from the center-of-gravity 45 in a direction away from the housing 15. As shown in FIG. 2, the handle 35 defines an axis 37 extending parallel to the plane 24 and perpendicular to the support surface S. The axis 37 passes near the center-of-gravity 45. In other embodiments, the handle 35 and the axis 37 may substantially coincide with the center-of-gravity 45. In other embodiments, the handle 35 may be offset from the center-of-gravity 45 in another position in a direction either toward or away from the housing 15 and in a location that facilitates portability and ease of transporting of the air compressor unit 10 for the user. The position of the handle 35 near the center of gravity 45 requires that less force is exerted by the user to transport the air compressor 10 by allowing the portable air compressor 10 to be carried by the user at a closer position to the user's body (FIG. 9) than if the handle 35 were at another location on the portable air compressor 10 (such as on an end of the air tank 20, an end of the housing 15, etc.).

The illustrated housing 15 includes a first housing portion 50 and a second housing portion 55 coupled together at a mating line 60A, 60B via fasteners (e.g., bolts, screws, rivets, or the like) to define the housing 15. The mating line 60A on one side of the housing 15 is vertical (FIGS. 1, 5, and 7) and the mating line 60B on the opposite side of the housing 15 is angled (FIG. 2). In other embodiments, the mating lines may display other configurations providing for the mating of the first and second housing portions.

The first housing portion 50 includes a first air inlet 65A and a second air inlet 65B for receiving ambient air into the housing 15. The first and second housing portions 50, 55 also form an air outlet 70. The air inlets 65A, 65B are positioned below a horizontal centerline 75 of the housing 15. Referring to FIG. 6, the first housing portion 50 is formed with a series of walls 115A, 120A, 115B, and 120B to define a tortuous air path for the ambient air entering the housing 15 through the first and second air inlets 65A, 65B. The first housing portion 50 also includes substantially L-shaped walls 122A, 122B, which also define the tortuous path for the ambient air. Although illustrated as L-shaped walls, in some embodiments, the walls may be another shape capable of providing the tortuous path. The walls 115A, 120A, 122A and 115B, 120B, 122B are symmetrical about the center axis 125 of the housing assembly 15. Referring to FIGS. 4 and 5, the second housing portion 55 is also formed with a series of walls 115A, 120A, 122A, 115B, 120B, 122B which mirror the series of walls formed in the first housing portion 50. When coupled along the mating line 60A, 60B, the walls of both housing portions 50, 55 align and the first housing portion 50 and the second housing portion 55 form a tortuous path for air flow through the housing 15 to provide noise attenuation.

The walls 115A, 120A, 122A, 115B, 120B, 122B on the first and second housing portions 50, 55 are integrally formed with the housing portions 50, 55. The first and second housing portions 50, 55 also include baffles 85 (FIG. 3) integrally formed in each of the first and second housing portions 50, 55. The baffles 85 provide further interaction with the air flow paths to attenuate noise. The series of walls 115A, 120A, 122A, 115B, 120B, 122B and the baffles 85 provide for noise attenuation and muffling. The first housing portion 50 further includes a protrusion 100, which is substantially Y-shaped in the illustrated embodiment, extending outwardly from the housing 15. The protrusion 100 forms a portion of a combined air flow path 110C. The air flow paths will be described in greater detail below. The first and second housing portions 50, 55 are formed of plastic. However, in other embodiments, other suitable materials or combination of materials may be used. The first and second housing portions 50, 55 may be formed with injection molding, stamping, or other suitable manufacturing process.

The housing 15 is configured to substantially surround the motor/compressor assembly 30, receive a portion of the air tank 20, and house at least a portion of the control assembly 25. The motor/compressor assembly 30 is positioned within the housing 15 adjacent to the air tank 20 as described above. The motor/compressor assembly 30 includes a compressor 32 in fluid communication with the air tank 20 and a motor 34 coupled to the compressor 32 to drive the compressor 32. The compressor 32 draws ambient air, by way of a fan 36 coupled to an end of a shaft of the motor 34, from the environment through the plurality of air inlets 65A, 65B into the housing 15, compresses the air, and directs the compressed air into the air tank 20 for storage and later use. In some embodiments, the compressor 32 may be, for example, a reciprocating compressor, a rotary screw compressor, a rotary vane compressor, or the like. In other embodiments, other suitable compressors may be employed.

A power cord (not shown) electrically connects the motor 34 to a wall outlet, selectively powering the motor 34 to selectively drive the compressor 32. In the illustrated embodiment, the motor 34 is a universal motor capable of using an AC supply current. In other embodiments, the motor may be a brushed or brushless DC motor, an induction motor, an AC synchronous motor, a stepper motor, or any other suitable electric motor. In further embodiments, the electric motor 34 may be replaced by a gasoline or diesel engine and an alternator. In still other embodiments, the portable air compressor 10 may include a portable and rechargeable DC power source, such as a battery pack or fuel cell.

As shown in FIGS. 1-4 and 7-9, the portable air compressor 10 includes a control assembly 25 coupled to the housing 15. The control assembly 25 is supported by the housing 15 and positioned to be readily visible and engageable by the user. The illustrated control assembly 25 includes a pair of gauges 90 and a regulator knob 95 extending outwardly through the first housing portion 50. The gauges 90 are in communication with the air tank 20 and motor/compressor assembly 30. Each gauge 90 includes a display that is visible to a user to display the pressure of the compressed air stored within the air tank 20 and/or to display an output pressure of the air (i.e., the pressure of the compressed air being discharged from the air tank 20). The displays of the illustrated gauges 90 may be analog or digital displays. The regulator knob 95 is rotatable by a user to adjust the output pressure from the air tank 20 for different applications (e.g., for pneumatic power tools requiring different operating pressures). The position of handle 35 also provides protection to the control assembly 25.

The housing 15 and the air tank 20 further include feet 105 to provide stability to the air compressor 10. A pair of feet 105 extends from a bottom of the housing 15, and a pair of feet 105 extends from a bottom of the air tank 20 in a direction substantially parallel to the plane 24 of the air tank 20 as defined above and generally opposite the handle 35. The feet 105 support the portable air compressor 10 on the support surface S when the air compressor 10 is not being transported by hand, i.e., when the compressor is in a resting position or operating position. The feet 105 are removably coupled to the housing 15. In the illustrated embodiment, the air tank 20 includes brackets for supporting the feet 105. In other embodiments, the feet may be integrally formed as a single piece with the housing portions. In the illustrated embodiment, each foot 105 is an elastomeric member, such as a rubber pad, configured to dampen vibrations and increase stability of the housing 15 when the air compressor 10 is in use. In some embodiments, the feet may be formed of other suitable material. In still other embodiments, wheels may be used in place of the feet, or wheels and feet may be used in combination.

In operation, ambient air enters the housing 15 through the first inlet 65A and follows a first air path 110A defined by the first walls 115A and the L-shaped walls 122A and travels upward until striking the second walls 120A. Upon contacting the second walls 120A, the first air path 110A moves toward the center axis 125 of the housing 15 until the air is pulled downward into the motor/compressor assembly 30 by the fan 36 located about the center axis 125 of the housing 15. Similarly, ambient air enters the housing 15 through the second inlet 65B and follows a second air path 110B defined by the first walls 115B and the L-shaped walls 122B by traveling upward until striking the second walls 120B. Upon contacting the second walls 120B, the second air path 110B moves toward the center axis 125 of the housing 15 until pulled downward into the motor/compressor assembly 30 by the fan 36 located about the center axis 125 of the housing 15. Upon entering the motor/compressor assembly 30, the first and second air paths 110A, 110B converge at a third air path 110C and proceed down the length of the housing 15 through the protrusion 100 until striking third walls 130 formed on the housing portions 50, 55. Upon contacting the third walls 130, the converged air path 110C moves toward the air outlet 70 to exit the housing 15.

In the illustrated embodiment, the first, second and third air flow paths 110A, 110B, 110C, respectively, are shown. However, there may be additional air flow paths that follow a similar tortuous path. The tortuous path provides for noise attenuation during operation of the portable air compressor 10. For example, current air compressors (i.e., an air compressor without the tortuous path formed in the housing) have a 84.9 dBA noise level during operation of the air compressor. However, the illustrated air compressor, including a housing having the tortuous path, provides a 78.5 dBA noise level during operation of the portable air compressor 10.

Although the invention has been described in detail with reference to certain preferred embodiments, variations and modifications exist within the scope and spirit of one or more independent aspects of the invention as described.

What is claimed is:

1. A portable air compressor having a resting position in which the air compressor is supported on a support surface, the portable air compressor comprising:

an air tank for storing compressed air, the air tank having a generally flattened spherical shape defining a circumference having a diameter and lying in a plane, the generally flattened spherical shape also defining a width perpendicular to the plane, wherein the diameter is greater than the width, and wherein the plane is oriented substantially perpendicular to the support surface when the air compressor is in the resting position;

compressor components in fluid communication with the air tank for providing the compressed air to the air tank, wherein the compressor components are positioned adjacent to the air tank substantially on one side of the plane of the air tank;

at least one foot coupled to the air tank and extending from the air tank in a direction substantially parallel to the plane of the air tank, the at least one foot for at least partially supporting the air compressor on the support surface such that the plane is oriented substantially perpendicular to the support surface when the tank is in the resting position; and a handle extending from the air tank in a direction substantially parallel to the plane of the air tank and in a direction generally opposite the at least one foot.

2. The portable air compressor of claim 1, wherein the handle includes a grip portion, wherein the air tank is positioned substantially between the grip portion and the support surface in a direction parallel to the plane.

3. The portable air compressor of claim 1, wherein the handle defines an axis through the handle that passes near a center of gravity of the air compressor.

4. The portable air compressor of claim 1, further comprising a housing substantially enclosing the compressor components.

5. The portable air compressor of claim 4, wherein the at least one foot is at least one first foot, wherein the housing includes at least one second foot extending from the housing in a direction substantially parallel to the plane of the air tank, the at least one second foot for at least partially supporting the air compressor on the support surface in cooperation with the at least one first foot such that the plane of the air tank is oriented substantially perpendicular to the support surface in the resting position.

6. The portable air compressor of claim 4, wherein the housing includes a concave outer surface for receiving a portion of the air tank.

7. The portable air compressor of claim 4, wherein the housing defines an air inlet, an air outlet and a tortuous flow path between the air inlet and the air outlet.

8. The portable air compressor of claim 1, wherein the plane is a first plane, and wherein the handle defines a second plane that is substantially parallel to the second plane.

9. The portable air compressor of claim 8, wherein the handle includes a bend lying substantially in the second plane.

10. The portable air compressor of claim 1, wherein the handle includes a grip portion and a connecting portion extending substantially from the air tank to the grip portion, wherein the connecting portion extends from the air tank in a direction substantially parallel to the plane.

11. The portable air compressor of claim 1, wherein the handle includes a grip portion defining a longitudinal axis extending in a direction substantially parallel to the plane.

12. A portable air compressor having a resting position in which the air compressor is supported on a support surface, the portable air compressor comprising:

an air tank for storing compressed air, the air tank having a generally flattened spherical shape defining a circumference having a diameter and lying in a plane, the generally flattened spherical shape also defining a width perpendicular to the plane, wherein the diameter is greater than the width, and wherein the plane is oriented substantially perpendicular to the support surface in the resting position;

compressor components in fluid communication with the air tank for providing the compressed air to the air tank, wherein the compressor components are positioned adjacent to the air tank substantially on one side of the plane of the air tank in the resting position;

a handle extending from the air tank in a direction substantially parallel to the plane of the air tank, the handle including a grip portion for a user to grasp when transporting the air compressor, wherein the direction in which the handle extends generally defines an axis passing through the grip portion that passes near a center of gravity of the air compressor.

13. The portable air compressor of claim 12, wherein the center of gravity is positioned within the air tank.

14. The portable air compressor of claim 13, wherein the center of gravity is positioned substantially midway between the support surface and a top of the air tank opposite the support surface.

15. The portable air compressor of claim 12, further comprising a housing substantially enclosing the compressor components and providing a flow path for air therethrough.

16. The portable air compressor of claim 15, further comprising:

a first foot coupled to the air tank and extending from the air tank in a direction substantially parallel to the plane of the air tank; and a second foot extending from the housing in a direction substantially parallel to the first foot for cooperating with the first foot to support the air compressor on the support surface such that the plane is oriented substantially perpendicular to the support surface in the resting position.

17. The portable air compressor of claim 15, wherein the housing includes a concave outer surface for receiving a portion of the air tank.

18. The portable air compressor of claim 15, wherein the housing defines an air inlet, an air outlet and a tortuous flow path between the air inlet and the air outlet.

19. The portable air compressor of claim 12, wherein the plane is a first plane, and wherein the handle defines a second plane that is substantially parallel to the first plane.

20. The portable air compressor of claim 19, wherein the handle includes a bend lying substantially in the second plane.

21. The portable air compressor of claim 12, wherein the handle includes a connecting portion extending substantially from the air tank to the grip portion, wherein the connecting portion extends from the air tank in a direction substantially parallel to the plane.

22. The portable air compressor of claim 12, wherein the grip portion defines a longitudinal axis extending in a direction substantially parallel to the plane.

23. A portable air compressor having a resting position in which the air compressor is supported on a support surface, the portable air compressor comprising:

an air tank for storing compressed air;

compressor components in fluid communication with the air tank for providing the compressed air to the air tank; and a housing substantially enclosing the compressor components, wherein the housing includes a first air inlet, a second air inlet, an air outlet, a first tortuous flow path between the first air inlet and the air outlet, and a second tortuous flow path between the second air inlet and the air outlet, wherein the first tortuous flow path and the second tortuous flow path converge to form a third flow path upstream of the air outlet and downstream of the compressor components;

wherein the housing further comprises a Y-shaped protrusion for directing the first and second tortuous flow paths to converge into the third flow path.

24. The portable air compressor of claim 23, wherein the air tank has a generally flattened spherical shape defining a circumference having a diameter and lying in a plane, the generally flattened spherical shape also defining a width perpendicular to the plane, wherein the diameter is greater than the width, and wherein the plane is oriented substantially perpendicular to the support surface.

25. The portable air compressor of claim 24, wherein the compressor components are positioned adjacent to the air tank substantially on one side of the plane of the air tank.

26. The portable air compressor of claim 23, wherein the housing further comprises:

a first series of internal walls positioned between the first inlet and the outlet to provide the first tortuous flow path; and a second series of internal walls positioned between the second inlet and the outlet to provide the second tortuous flow path.

27. The portable air compressor of claim 26, wherein the first series of walls is substantially symmetrical to the second series of walls.

* * * * *